United States Patent [19]

Masuda et al.

[11] Patent Number: 4,585,020

[45] Date of Patent: Apr. 29, 1986

[54] SELF-CONTAINED TENT

[75] Inventors: Teruo Masuda, Tokyo; Masahiro Matsuzaki, Sayama; Shoji Oshita, Tokyo, all of Japan

[73] Assignee: France Bed Co. Ltd., Tokyo, Japan

[21] Appl. No.: 626,412

[22] Filed: Jun. 29, 1984

[30] Foreign Application Priority Data

| | | | |
|---|---|---|---|
| Jul. 8, 1983 | [JP] | Japan | 58-123491 |
| Nov. 24, 1983 | [JP] | Japan | 58-181264[U] |
| Nov. 24, 1983 | [JP] | Japan | 58-181265[U] |
| Nov. 24, 1983 | [JP] | Japan | 58-181266[U] |
| Dec. 20, 1983 | [JP] | Japan | 58-194868[U] |
| Apr. 16, 1984 | [JP] | Japan | 59-75025 |
| Apr. 16, 1984 | [JP] | Japan | 59-54706[U] |

[51] Int. Cl.[4] ..... E04H 15/06; E04H 15/30; E04H 15/46

[52] U.S. Cl. ..... 135/95; 135/88; 135/107; 135/901

[58] Field of Search ..... 135/88, 95, 101, 106, 135/107, 108, 109, 113, 119, 900, 901, 902, 96

[56] References Cited

U.S. PATENT DOCUMENTS

| | | | |
|---|---|---|---|
| 3,539,219 | 11/1970 | Mueller | 135/96 X |
| 3,620,235 | 11/1971 | DuPlessis | 135/113 X |
| 3,712,316 | 1/1973 | Leonard | 135/88 |
| 3,739,536 | 6/1973 | Ward | 135/113 X |
| 3,844,300 | 10/1974 | Sanders . | |
| 3,924,365 | 12/1975 | Orberg | 135/88 X |
| 3,995,649 | 12/1976 | Robichaud | 135/107 X |
| 4,050,732 | 9/1977 | MacIsaac | 135/107 X |
| 4,058,133 | 11/1977 | Barr et al. | 135/113 X |
| 4,084,597 | 4/1978 | Compton | 135/901 X |
| 4,239,247 | 12/1980 | Hinz | 135/113 X |
| 4,271,856 | 6/1981 | Ferguson | 135/113 |

FOREIGN PATENT DOCUMENTS

| | | | |
|---|---|---|---|
| 249526 | 4/1948 | Switzerland . | |
| 862011 | 3/1961 | United Kingdom | 135/113 |
| 2110261 | 6/1983 | United Kingdom . | |

*Primary Examiner*—Robert A. Hafer
*Assistant Examiner*—Terrence L. B. Brown
*Attorney, Agent, or Firm*—Frishauf, Holtz, Goodman and Woodward

[57] ABSTRACT

A self-contained tent includes a flat rectangular case which can be freely opened or closed. A tent sheet and a plurality of substantially U-shaped frame pipes are held in the case. The two ends of each frame pipe are pivotally supported in the case through a pair of supports. When the tent sheet is held in the case, the sheet covers the frame pipes. An edge of the tent sheet is attached to the edge of the case through a seal element, and the frame pipes are fastened at predetermined inner surface positions of the tent sheet.

13 Claims, 13 Drawing Figures

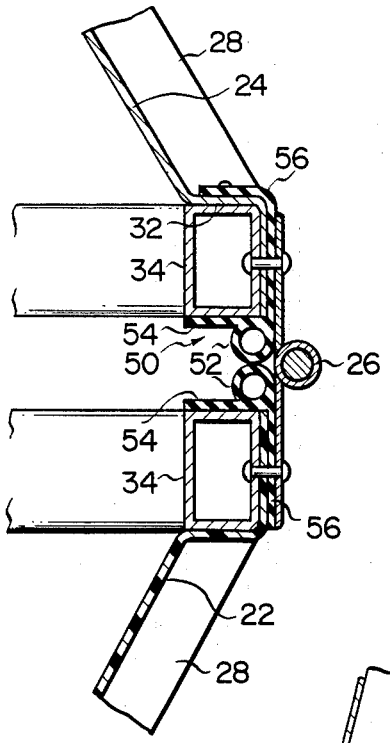
FIG. 4
FIG. 5
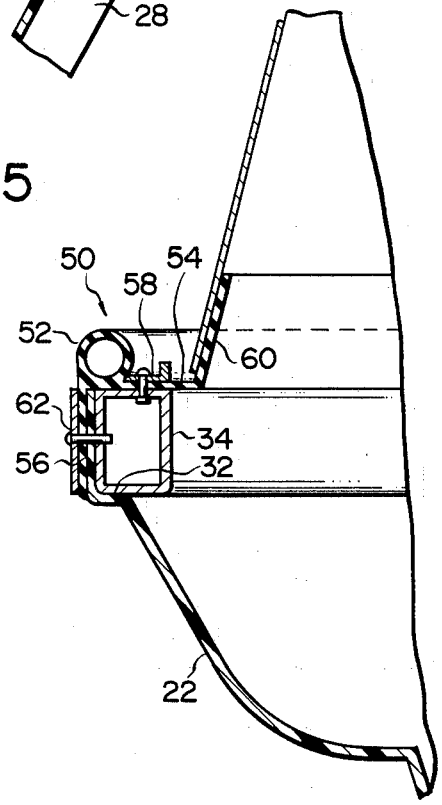

SELF-CONTAINED TENT

BACKGROUND OF THE INVENTION

The present invention relates to a tent allowing for easy assembly or disassembly and, more particularly, to a self-contained tent suitable for use in a campground (i.e., a camping site accessible to automobiles).

A conventional camping tent comprises a frame consisting of a tubular skeleton structure and a flexible sheet which covers the frame. The frame is generally assembled by fitting together a plurality of pipes or poles. When such a conventional tent is used, the frame is assembled and the sheet cover is opened out to cover the frame. Guy-ropes of the sheet cover are fixed on the ground through toggles and tent-pegs to complete the tent assembly. On the other hand, when the tent is disassembled, the sheet cover is removed from the frame and the frame is broken up into the constituent pipes. However, according to this conventional tent, the assembly and disassembly of the frame is time-consuming. It is not easy to pitch or to take down the tent, thus resulting in inconvenience. In addition to this disadvantage, it is sometimes impossible to pitch the tent due to ground conditions. When the ground is too soft or hard, the guy-ropes cannot be firmly supported. As a result, the tent cannot be maintained in a good shape.

In order to solve the drawbacks of the conventional tent described above, a self-contained tent assembly is described in, for example, U.S. Pat. No. 4,058,133. The assembly efficiency of this self-contained tent is better than that of the assembly type conventional tent. The conventional self-contained tent is firmly attached to the roof of an automobile. After it has been raised on the roof, the occupant may climb a ladder and enter the tent. It is hard to detach the tent from the roof of the automobile. Even if the tent is detached, to set it up on the ground is difficult and time-consuming since it is heavy.

SUMMARY OF THE INVENTION

The object of the present invention is to provide a self-contained tent which is light, easy to carry and can be raised with a simple operation.

In order to achieve the above object of the present invention, there is provided a self-contained tent comprising: a flat case which can be freely opened or closed, said flat case including first and second halves, each of which has a plurality of reinforcing ribs on the outer surface thereof, and a hinge means for coupling said first and second halves, said first and second halves being pivotable about an axis of the hinge means in opposite directions; a plurality of frame members held in said case, each of said frame members having two ends spaced apart along an axial direction of the hinge means; connecting means for connecting the two ends of each of said frame members so as to be pivotal about a line parallel to the axis of the hinge means with respect to said case; a flexible bag-like tent sheet which has an edge and which can be held in said case while said flexible tent sheet covers said plurality of frame members, an inner surface of said flexible tent sheet being attached to said plurality of frame members, said flexible tent sheet covering said plurality of frame members so as to constitute a closed space above said first and second halves when said first and second halves are opened; and a seal means for liquid-tightly attaching the edge of said flexible tent sheet to the peripheries of the first and second halves pivoted in the opposite directions.

According to the present invention, all members required for tent assembly are held in the case. When the case is opened, the tent is pitched in a one-touch manner, thereby simplifying the tent assembly. When the tent is to be disassembled, the user only has to close the case. In addition, since both halves of the case are provided with reinforcing ribs, they have great mechanical strengths. They may therefore be made thin, whereby the self-contained tent can be light and portable.

Other objects, features and advantages of the present invention will be apparent from the following detailed description in conjunction with the accompanying drawings.

BRIEF DESCRIPTION OF THE DRAWINGS

FIG. 4 is an enlarged sectional view of a hinge portion of the case of FIG. 1;

FIG. 5 is a partial sectional view of an outer wall portion of the tent when it is assembled;

DETAILED DESCRIPTION OF THE PREFERRED EMBODIMENTS

Figure 1:
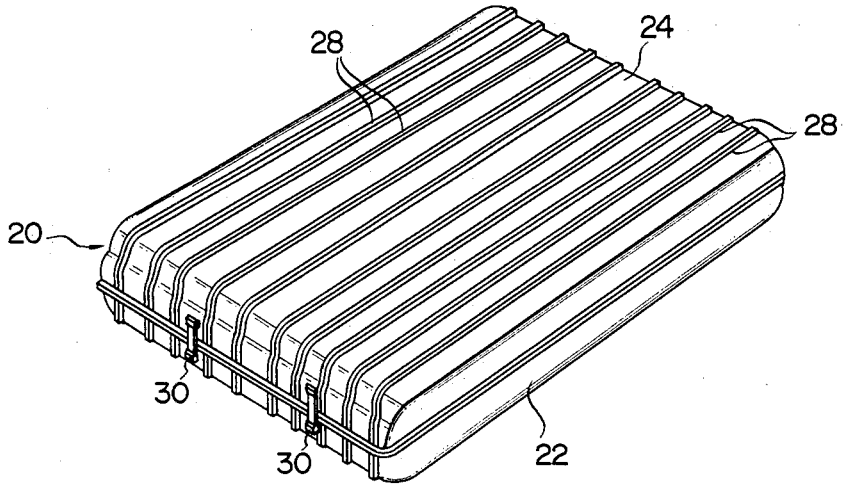
FIG. 1 is a perspective view of a case of a self-contained tent according to a first embodiment when the tent is being stored.
Figure 2:
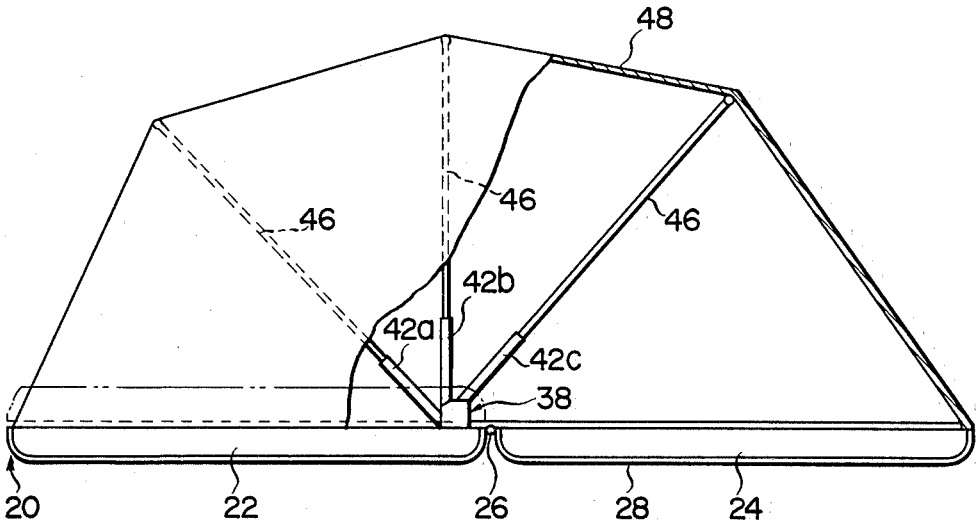
FIG. 2 is a side view of the self-contained tent of FIG. 1 when it is assembled.
Figure 3:
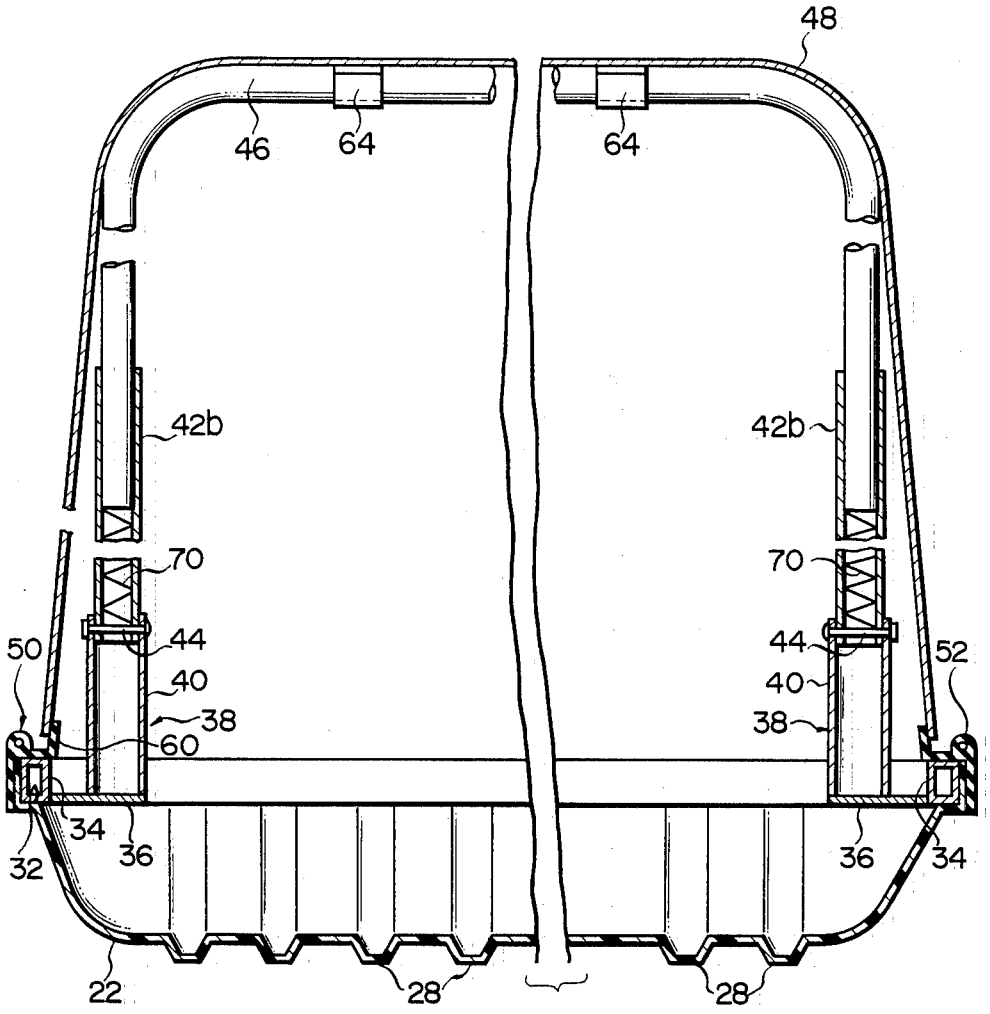
FIG. 3 is an enlarged sectional view of the self-contained tent of FIG. 1 when it is assembled.

A self-contained tent according to a first embodiment of the present invention is illustrated in FIGS. 1 to 5. FIG. 1 shows the self-contained tent when it is not assembled. This tent has a case 20. The case 20 includes first and second halves 22 and 24 of a flat rectangular shape, and is made of a synthetic resin and a hinge 26 for coupling the corresponding edges of the first and second halves 22 and 24. The first and second halves 22 and 24 can be pivoted about the axis of the hinge 26 along opposite directions. When the first and second halves 22 and 24 are pivoted, they are aligned on the same plane, as shown in FIG. 2. A plurality of reinforcing ribs 28 is integrally formed on the outer surfaces of the first and second halves 22 and 24 at predetermined intervals. The reinforcing ribs 28 extend partially outward from the outer wall surfaces of the first and second halves 22 and 24, as shown in FIG. 3. In this embodiment, the reinforcing ribs 28 extend only along the lengthwise direction of the case 20. However, the ribs may also extend along the lengthwise direction and along the direction perpendicular thereto. When the first half 22 is brought into tight contact with the second half 24 (i.e., when the case 20 is closed as shown in FIG. 1), the first and second halves 22 and 24 can be connected through a pair of known locks 30.

As shown in FIGS. 3 to 5, stepped portions 32 are formed on the peripheries of the first and second halves 22 and 24. Reinforcing frames 34 made of, for example, hollow aluminum rectangular pipes are mounted on the stepped portions 32 along the peripheries of the first and second halves 22 and 24, respectively. A pair of mounting plates 36 is mounted at corners of one half of the reinforcing frame 34 (i.e., the first half 22) and extends along the horizontal direction in FIG. 3; these corners are close to the hinge 26.

Supports 38 are mounted on the mounting plates 36, as shown in FIG. 3, respectively. Each support 38 has a pair of support plates 40 which extend upward from the corresponding mounting plate 36 and are spaced apart by a predetermined distance along the direction of the width of the case 20 (in this case, the first half 22). One end of each of the three support pipes 42*a*, 42*b* and 42*c* is inserted between the support plates 40 of one of the supports 38 and is pivotally supported by the support plates 40 through a support shaft 44 extending parallel to the axis of the hinge 26. The other end of each of the other three support pipes 42*a*, 42*b* and 42*c* are pivotally supported between the support plates 40 of the other support 38. The support pipes of one support 38 and the corresponding support pipes of the other support 38 constitute support pipe pairs, respectively.

The two ends of each of the three U-shaped frame pipes 46 are slidably inserted in the corresponding pair of the support pipes 42*a*, 42*b* and 42*c* of the supports 38. Therefore, the frame pipes 46 are supported on the corresponding supports 38 to be pivotal about the support shafts 44. Coil springs 70 are disposed in the support pipes 42 and are positioned between the ends of the respective frame pipes 46 and the support shafts 44. The respective frame pipes 46 are elastically supported by the corresponding coil springs 70 on the corresponding supports 38. It should be noted that the respective frame pipes 46 are sufficiently short to be held in the case 20.

A flexible waterproofed tent sheet 48 of a material such as canvas can be held in the case 20. The tent sheet 48 is sewn in a predetermined bag-like shape having an edge so as to cover the case 20 and to form a closed space having the case 20 as a base when the first and second halves 22 and 24 are pivoted to open the case 20, as shown in FIGS. 2 and 3.

The edge of the tent sheet 48 is liquid-tightly coupled to the periphery (i.e., the peripheries of the first and second halves 22 and 24 which exclude the edges thereof coupled through the hinge 26) of the opened case 20 through a sealing assembly 50. The sealing assembly 50 is illustrated in detail in FIGS. 4 and 5. The sealing assembly 50 is disposed along the entire peripheries of the first and second halves 22 and 24 and has packing projections 52 which are brought into tight contact with each other when the case 20 is closed. The packing projections 52 are made of an elastic material such as rubber or a synthetic resin. In this embodiment, the packing projections 52 have hollow pipe portions, respectively. A first connecting member 54 is formed integrally with the entire inner wall edge of each packing projection 52 along the outer wall of the reinforcing frame 34 toward the inside of the tent. A second connecting member 56 is formed integrally with the entire outer wall edge of each packing projection 52. The first connecting member 54 is mounted on the outer wall surface of the reinforcing frame 34 by a plurality of fastening means 58 including a press plate and screws. Alternatively, the first connecting member 54 may be adhered to the outer wall surface. The inner edge of the first connecting member 54 excluding the portion on the side of the hinge 26 is bent upward, as shown in FIG. 5. In this manner, as shown in FIGS. 3 and 5, the edge of the tent sheet 48 is liquid-tightly coupled by sewing or adhesion to a bent portion 60 of the first connecting member 54 of each of the first and second halves 22 and 24. On the other hand, the second connecting member 56 is coupled to the outer wall surface of the tent through a plurality of fastening members 62 including a press plate and screws.

Loop portions 64 are formed on the inner surface of the tent sheet 48 which serves as a ceiling so as to attach the tent sheet 48 to the respective frame pipes 46. In this manner, since the tent sheet 48 is attached to the frame pipes 46 and the first and second halves 22 and 24, when the frame pipes 46 are pivoted about the corresponding shafts 44 of each support 38 upon opening the case 20, the tent sheet 48 is automatically stretched, as shown in FIG. 2. The size of the stretched tent sheet 48 is determined so as to compress the coil springs 70 held in the corresponding support pipes 42 of the supports 38 through the two ends of the corresponding frame pipes 46. As a result, when the tent sheet 48 is stretched, it can be biased by the biasing force of the springs 70 in a direction away from the support pipes 42. Therefore, the tent sheet 48 is kept taut.

Furthermore, a flap door (not shown) is also formed in the tent sheet 48 and can be opened or closed by a fastener.

According to the tent of the first embodiment, the tent can be pitched in a one-touch manner as shown in FIG. 2 when the case 20 is opened, and when the first and second halves 22 and 24 are pivoted in the opposite directions. In addition, in order to put away the tent, the user only has to close the case 20 in order to hold the tent components therein.

Also, with the present tent, the case 20 can serve as a base when it is assembled. Therefore, ground conditions do not interfere with the setting-up operation of the tent.

The case 20 is made of a synthetic resin. The first and second halves 22 and 24 forming the case 20 are provided with reinforcing ribs 28 on their outer surfaces. The case 20, i.e., the halves 22 and 24, can therefore be made thinner without reducing its mechanical strength. Hence, the tent as a whole may be light and portable and can easily be set up.

The packing projections 52 are respectively formed along the peripheries of the first and second halves 22 and 24 of the case 20 of the tent. The packing projections 52 of the first and second halves 22 and 24 are brought into elastic contact with each other when the case 20 is closed. Even if rain falls on the case 20 when being carried, the waterproofness can be guaranteed.

The present invention is not limited to the tent of the first embodiment. For example, FIGS. 6 to 12 illustrate a tent according to a second embodiment to be described below. The same reference numerals used in FIGS. 6 to 12 denote the same parts as in the first embodiment, and a detailed description thereof will be omitted. Only the differences will be described.

Figure 6:
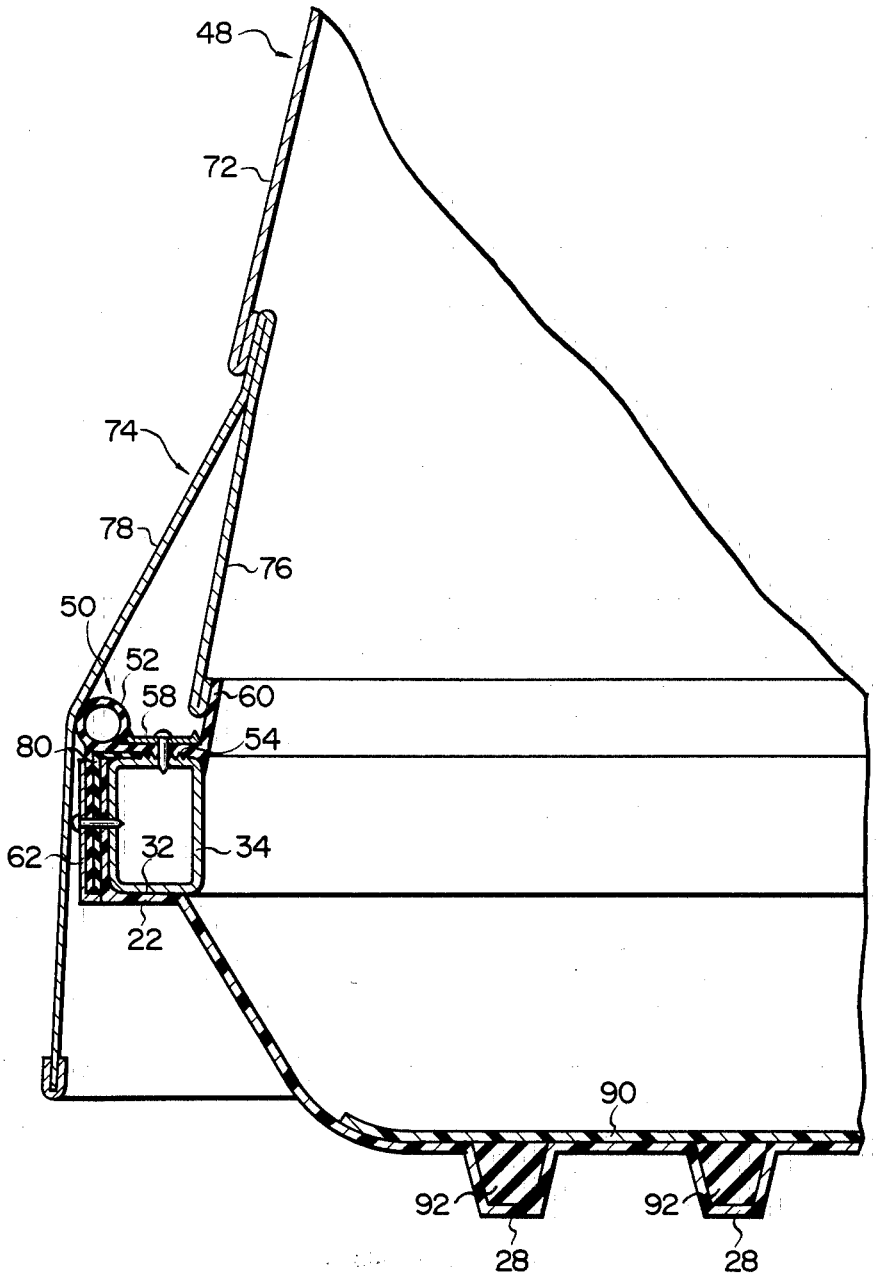
FIG. 6 is a partial sectional view of an outer wall of a self-contained tent according to a second embodiment when it is assembled.
Figure 7:
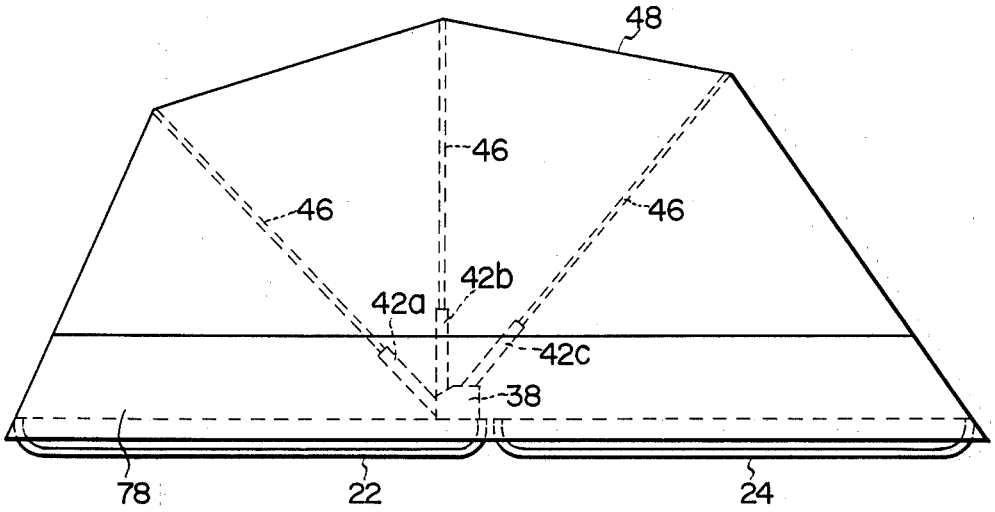
FIG. 7 is a side view showing the overall construction of the tent of FIG. 6.

FIG. 6 is a partial sectional view of a self-contained tent according to the second embodiment. A tent sheet 48 of the second embodiment comprises a first sheet 72 sewn in the same bag-like manner as in the first embodiment and a second sheet 74 liquid-tightly attached to the first sheet 72 and being of the same material as that of the first sheet 72. The second sheet 74 has a bag-like structure with open ends which is folded to constitute a two-layer structure. The folded portion of the two-layer structure is coupled to the edge of the first sheet 72. An inner sheet 76 of the two-layer structure at the unfolded end is liquid-tightly coupled to first connecting members 54 of packing projections 52 of a sealing assembly 50. As is apparent from FIG. 6, an outer sheet 78 of the two-layer structure is longer than the inner sheet 76 so as to surround the outer wall of the case 20 when the case 20 is opened. According to the tent sheet 48 described above, since the sealing assembly 50 is covered by the outer sheet 78 of the tent sheet 48, as shown in FIG. 7, the sealing assembly 50 can be protected against rain, thereby further improving the liquid tightness of the inside of the tent.

Figure 8:
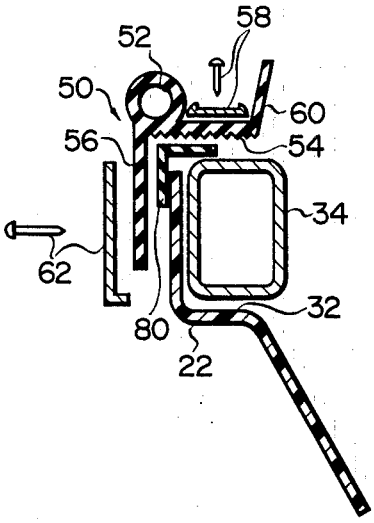
FIG. 8 is an exploded view of a sealing assembly shown in FIG. 6.
Figure 9:
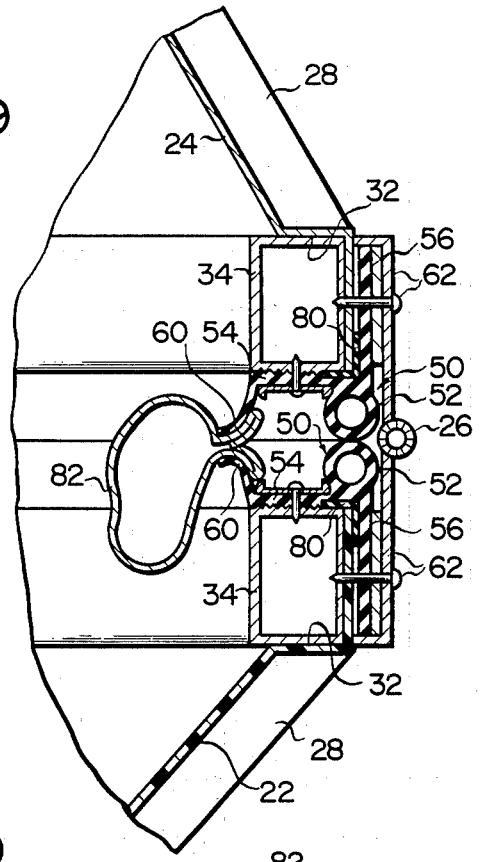
FIG. 9 is a sectional view of a hinge portion of the tent shown in FIG. 6 when the case is closed.

Furthermore, according to the second embodiment, the lower end face of each first connecting member 54 of the sealing assembly 50, the lower endface being contacted with the outer wall of the corresponding frames 34, comprises a corrugated surface, as shown in FIG. 8. The first and second connecting members 54 and 56 of the sealing assembly 50 are coupled to the outer wall of the tent and to a reinforcing frame 34 through an intermediate sealing material 80 made from, e.g. silicone rubber. Therefore, according to this sealing assembly 50, sealing between the first connecting member 54 and the reinforcing frame 34, and between the second connecting member 56 and the outer wall of the tent is improved, as compared with the sealing assembly of the first embodiment.

Figure 10:
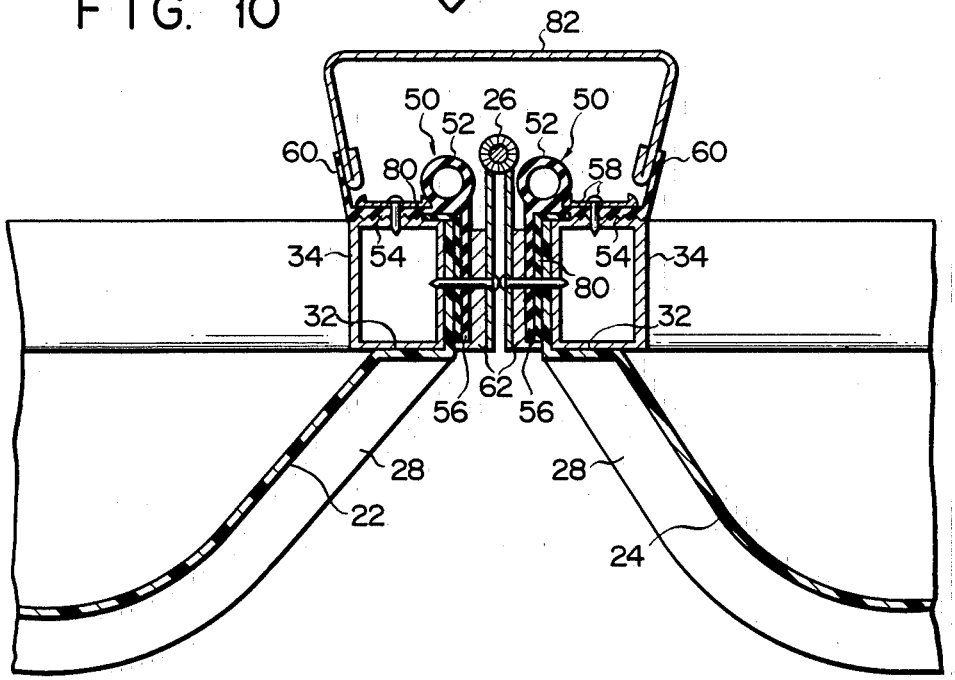
FIG. 10 is a sectional view of the hinge portion of the tent shown in FIG. 6 when the case is opened.
Figure 11:
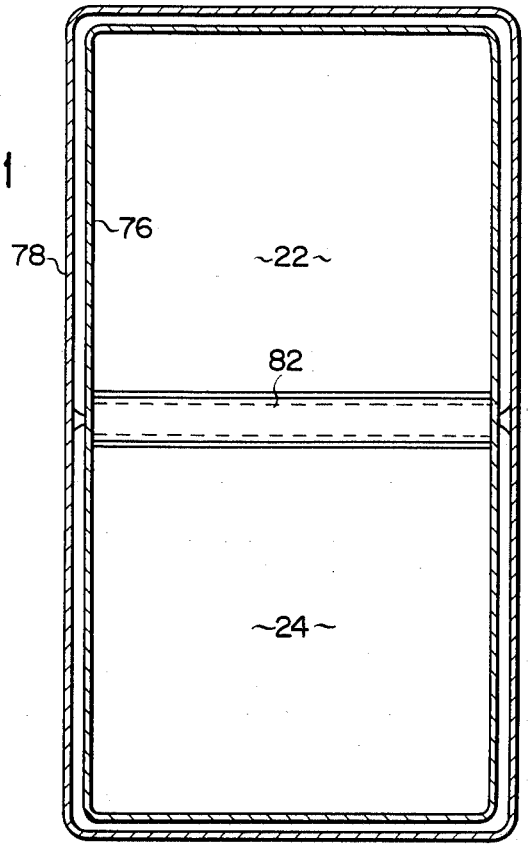
FIG. 11 is a schematic view showing the inside of the tent of FIG. 6.
Figure 12:
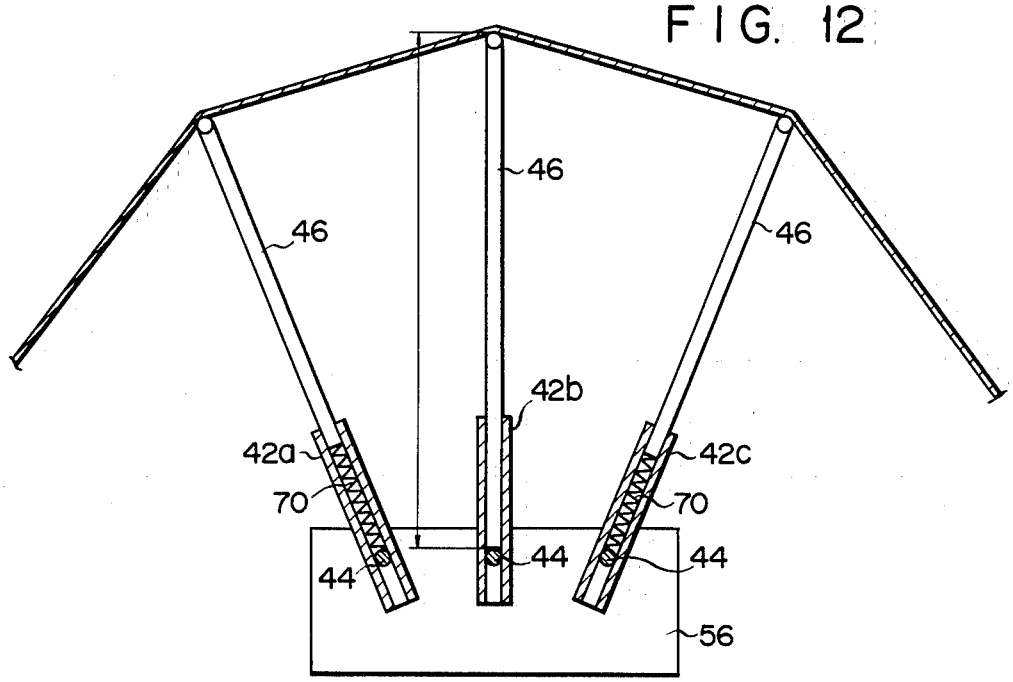
FIG. 12 is a schematic view for explaining the function of three frame pipes.

Furthermore, according to the sealing assembly 50 of the second embodiment, first connecting members 54 having bent portions 60 are respectively formed on the packing projections 52 also at the side of the hinge 26. The coupling portion of the first and second halves 22 and 24 through the hinge 26 is covered with a flexible hinge sheet 82 made of the same material as that of the tent sheet 48. As shown in FIGS. 10 and 11, the edges of the hinge sheet 82 are coupled to the bent portions 60 of the first connecting members 54 such that the hinge sheet 82 covers the hinge 26. Another pair of opposing edges of the hinge sheet 82 are coupled to the inner surface 76 of the tent sheet 48, as shown in FIGS. 10 and 11. When the hinge sheet 82 described above is provided, a double waterproof structure can be obtained in the hinge portion of the case 20 in the same manner as in the waterproof structure of the outer portion, thereby further improving the sealing of the tent.

In the second embodiment, as shown in FIG. 6, reinforcing plates 90 are respectively disposed on the inner surfaces of the halves 22 and 24 so as to close the openings of the reinforcing ribs 28. The reinforcing plate 90 comprises a plate or a laminate of a heat-insulating material such as a synthetic resin (i.e., polyethylene). In addition, a heat-insulating material 92 is filled in the reinforcing ribs 28. the heat-insulating material 92 may comprise rubber, a synthetic resin such as styrol or urethane, or a foamable synthetic resin such as foamable styrol or foamable urethane. The heat-insulating material 92 is preformed into members having predetermined dimensions corresponding to the interior of each rib. The heat-insulating members are respectively fitted in the reinforcing ribs 28 and fixed with an adhesive, respectively.

When the heat-insulating material 92 is a foamable synthetic resin, the resin is foamed in the reinforcing ribs 28 and fills up the rib interiors.

When the case 20 has the above construction, the mechanical strength of the case 20 is increased by the reinforcing plates 90. In addition to this advantage, the inner bottom surfaces of the first and second halves 22 and 24 can be flattened, thereby making the assembled tent more comfortable for the user. Furthermore, since the heat-insulating material 92 is filled in the reinforcing ribs 28, heat will not be easily dissipated through the floor of the first and second halves 22 and 24, thereby improving the heat insulation properties of the tent.

In the second embodiment, at least one (i.e., support pipe **42*b* in FIG. 12) of the support pipes 42 of each support 38 need not have the coil spring 70 therein. In this case, the two ends of the frame pipe 46 slidably fitted in the support pipe 42*b* are directly coupled to the support shaft 44. Even if the frame pipes 46 are elastically supported by the corresponding support pipes 42*a* and 42*c* of the supports 38, the tent sheet 48 will not vibrate by the external pressure caused by rain and wind since the height of the sheet 48 is limited to a height by the frame pipes 46 directly held by the support pipes 42**.

Figure 13:
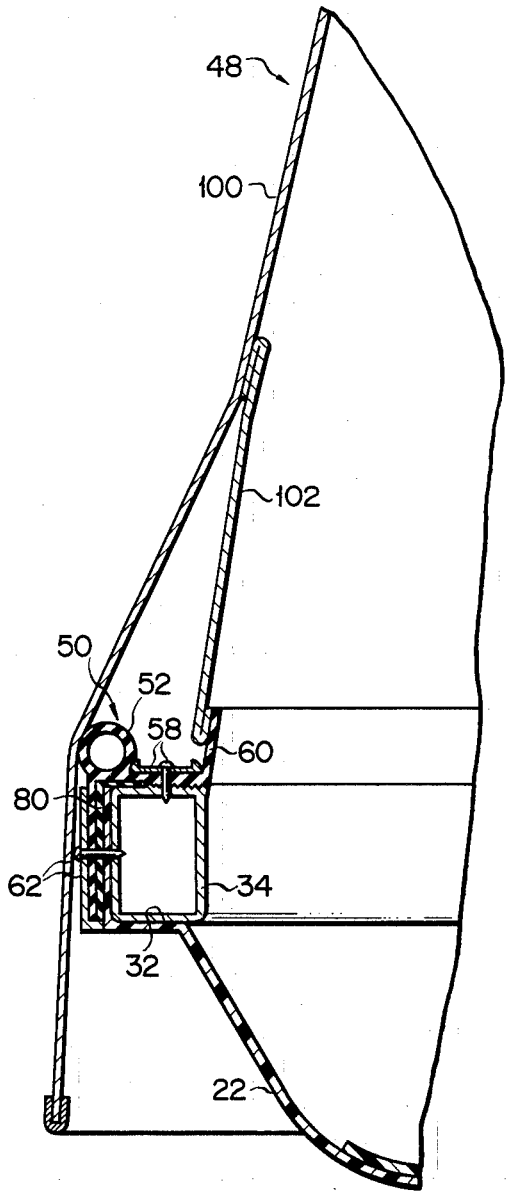
FIG. 13 is a partial sectional view of an outer wall of a tent according to a third embodiment when it is assembled.

FIG. 13 shows a tent sheet 48 according to a third embodiment of the present invention. The tent sheet 48 of the third embodiment slightly differs from that of the second embodiment. The tent sheet 48 according to the third embodiment comprises a first sheet 100 consisting of the first sheet and the outer sheet of the second sheet 74 of the second embodiment, and a second sheet 102 consisting of the inner sheet 76 of the second embodiment. The tent sheet 48 of the third embodiment has the same waterproof effect as in the second embodiment.

What is claimed is:

1. A self-contained tent, comprising:

a flat case which can be freely opened or closed, said flat case including first and second halves, each of which has a plurality of hollow reinforcing ribs on the outer surface thereof, and hinge means for coupling adjacent ends of the first and second halves, the first and second halves being pivotable about an axis of the hinge means in opposite opening and closing directions;

heat-insulating material provided in the interiors of said hollow reinforcing ribs;

reinforcing plates disposed on the inner surfaces of the first and the second halves of said flat case, and on exposed portions of said heat-insulating material which fills the rib interiors;

a plurality of frame members held in said case, each of said frame members having two ends spaced apart along an axial direction of the hinge means;

connecting means for connecting the two ends of each frame member to the inner surface of at least one of the halves of said case so that said frame members can pivot in the opening/closing direction of said case;

a flexible bag-like tent sheet which has an edge and which can be held in said case while said flexible tent sheet covers said plurality of frame members, an inner surface of said flexible tent sheet being attached to said plurality of frame members, said flexible tent sheet covering said plurality of frame members so as to constitute a closed space above the first and second halves when the first and second halves are opened; and seal means for liquid-tightly attaching the edge of said flexible tent sheet to peripheries of the first and second halves pivoted in the opposite directions.

2. A tent according to claim 1, wherein said heat-insulating material comprises a foamable synthetic resin.

3. A tent according to claim 1, wherein said frame member comprises a substantially U-shaped pipe.

4. A tent according to claim 1, wherein said connecting means is disposed in a vicinity of a side wall of one of said first and second halves, the vicinity being located at a hinge means side.

5. A tent according to claim 4, wherein said connecting means comprises:

a pair of supports disposed to be spaced apart along the axial direction of the hinge means;

support pipes of the same number as that of the ends of said frame members and whose proximal ends are supported by each pair of supports, pivotally in the opening/closing direction of said case, two ends of each of said frame members being slidably fitted in a corresponding pair of the support pipes of the pair of supports; and coil springs held in the support pipes of each of the pair of supports so as to elastically support the ends of said frame members.

6. A tent according to claim 4, wherein said connecting means comprises:

a pair of supports disposed to be spaced apart along the axial direction of the hinge means;

support pipes of the same number as that of the ends of said frame members and whose proximal ends are supported by each pair of supports, pivotally in the opening/closing direction of said case, two ends of each of said frame members being slidably fitted into a corresponding pair of the support pipes of the pair of supports; and coil springs held in the support pipes of each of the pair of supports, excluding at least one pair of support pipes of the pair of supports, so as to elastically support the ends of said frame members.

7. A tent according to claim 1, wherein said tent sheet comprises an outer sheet at the periphery of the tent sheet, for covering the edge of the tent sheet and the outer peripheries of the first and the second halves of said case when said case is opened.

8. A tent according to claim 1, wherein said seal means comprises: elastic packing projections respectively extending from the peripheries of the first and second halves thereon, the packing projections being elastically brought into contact with each other to keep an inside of said case liquid-tight when said case is closed; a first connecting member integrally formed with an inner edge of each of the packing projections, extending inward a corresponding one of the first and second halves, and liquid-tightly connected to the edge of said tent sheet; and a second connecting member formed along an outer wall of a corresponding one of the first and second halves and liquid-tightly connected to the outer wall thereof.

9. A tent according to claim 1, wherein said seal means includes a flexible hinge sheet which liquid-tightly covers the coupling ends of the first and second halves hinged by the hinge means.

10. A tent according to claim 8, wherein the packing projections of said seal means have a substantially pipe-like shape.

11. A tent according to claim 1, wherein said case further comprises hollow prism-shaped reinforcing frames along inner walls of the first and second halves; and said seal means comprises: elastic packing projections respectively extending from the peripheries of the first and second halves thereon, the packing projections being elastically brought into contact with each other to keep an inside of said case liquid-tight when said case is closed; a first connecting member which extends integrally with an inner edge of each of the packing projections along an outer wall of a corresponding one of the prism-shaped reinforcing frames of a corresponding one of the first and second halves and which is liquid-tightly coupled to the edge of said tent sheet; and a second connecting member which is formed along an outer wall of a corresponding one of the first and second halves and which is liquid-tightly fixed on the outer wall thereof.

12. A tent according to claim 11, wherein a contact surface of the first connecting member of said seal means with the corresponding one of the reinforcing frames comprises a corrugated surface, and said seal means further comprises seal material inserted between each of the packing projections and a corresponding one of the first and second halves.

13. A self-contained tent, comprising:

a flat case which can be freely opened or closed, said flat case including first and second halves, each of which has a plurality of reinforcing ribs on the outer surface thereof, hinge means for coupling adjacent ends of the first and second halves so that the first and second halves are pivotable about an axis of the hinge means in opposite opening and closing directions, and hollow prism-shaped reinforcing frames along inner walls of the first and second halves;

connecting means for connecting each of said frames to the inner surface of a corresponding one of the halves of said case so that the frame can pivot in the opening/closing direction of said case;

a flexible bag-like tent sheet which has an edge and which can be held in said case while said flexible tent sheet covers said reinforcing frames, an inner surface of said flexible tent sheet being attached to said reinforcing frames, said flexible tent sheet covering said reinforcing frames so as to constitute a closed space above the first and the second halves of said case when the first and second halves are opened; and seal means for liquid-tightly attaching the edge of said flexible tent sheet to peripheries of the first and second halves which peripheries pivot in opposite directions when said case is opened or closed, said seal means comprising elastic packing projections respectively extending from the peripheries of the first and second halves, said projections being arranged to elastically contact one another to maintain the interior of said case liquid-tight when said case is closed;

a first connecting member which extends integrally with an inner edge of each of said projections along an outer wall of a corresponding one of the prism-shaped reinforcing frames on the associated one of the first and second halves, said first connecting member being liquid-tightly coupled to the edge of said tent sheet and having a corrugated surface;

a second connecting member which is formed along an outer wall of a corresponding one of the first and second halves and which is liquid-tightly fixed on the outer wall thereof; and seal material inserted between each of said elastic packing projections and a corresponding one of the first and second halves of said case.

* * * * *